US008651829B2

(12) United States Patent
Lim et al.

(10) Patent No.: US 8,651,829 B2
(45) Date of Patent: Feb. 18, 2014

(54) VACUUM PUMP FOR VEHICLES

(75) Inventors: Chang Sik Lim, Chungbuk (KR); Ki Ho Jung, Chungbuk (KR); Jang Ho Lee, Chungbuk (KR); Byung Jun Byun, Chungbuk (KR)

(73) Assignee: Kamtec Inc., Iwol-Myeon (KR)

( * ) Notice: Subject to any disclaimer, the term of this patent is extended or adjusted under 35 U.S.C. 154(b) by 543 days.

(21) Appl. No.: 12/818,043

(22) Filed: Jun. 17, 2010

(65) Prior Publication Data

US 2010/0319798 A1 Dec. 23, 2010

(30) Foreign Application Priority Data

Jun. 18, 2009 (KR) ..... 10-2009-0054477

(51) Int. Cl.
*B60P 3/22* (2006.01)

(52) U.S. Cl.
USPC ..... 417/312; 417/410.3

(58) Field of Classification Search
USPC ..... 417/312, 360, 410.3
See application file for complete search history.

(56) References Cited

U.S. PATENT DOCUMENTS

| | | | | |
|---|---|---|---|---|
| 3,568,769 | A * | 3/1971 | Maass | 166/75.13 |
| 4,950,133 | A * | 8/1990 | Sargent | 417/312 |
| 5,531,573 | A * | 7/1996 | Nokubo | 417/360 |
| 5,868,175 | A * | 2/1999 | Duff et al. | 141/59 |
| 6,491,505 | B1 * | 12/2002 | Hueser et al. | 417/410.3 |
| 2004/0191084 | A1 * | 9/2004 | Wang | 417/312 |
| 2008/0175723 | A1 * | 7/2008 | Muhs | 417/68 |
| 2008/0308062 | A1 * | 12/2008 | Morita et al. | 123/196 R |

FOREIGN PATENT DOCUMENTS

| | | | |
|---|---|---|---|
| CN | 201241828 | Y | 5/2009 |
| DE | 102006058980 | * | 6/2008 |
| DE | 102006058980 | A1 * | 6/2008 |
| EP | 2 253 848 | A2 | 11/2010 |
| JP | 04-187891 | A | 7/1992 |
| JP | 09-105393 | A | 4/1997 |
| JP | 11-210660 | A | 8/1999 |
| JP | 18-017024 | A | 1/2006 |
| JP | 2010-265833 | A | 11/2010 |

OTHER PUBLICATIONS

Chinese Office Action dated Feb. 28, 2012 as received in application No. 201010242128.0.

Japanese Office Action dated May 29, 2012 as received in application No. 2010-139832.

* cited by examiner

*Primary Examiner* — Peter J Bertheaud
*Assistant Examiner* — Dominick L Plakkoottam
(74) *Attorney, Agent, or Firm* — Maschoff Brennan

(57) ABSTRACT

Disclosed is a vacuum pump for vehicles which reduces noise of exhaust air generated during operation of the vacuum pump.

15 Claims, 19 Drawing Sheets

VACUUM PUMP FOR VEHICLES

This application claims the benefit of Korean Patent Application No. 10-2009-0054477 filed on 18 Jun. 2009, which is hereby incorporated by reference as if fully set forth herein.

BACKGROUND OF THE INVENTION

1. Field of the Invention

The present invention relates to a vacuum pump for vehicles which supplies a vacuum to components of a vehicle requiring the vacuum.

2. Discussion of the Related Art

In general, a vacuum pump installed in a vehicle generates a vacuum through rotation of a rotor, and exhausts air generated during compression of the vacuum pump to the outside.

The conventional vacuum pump generates unnecessary noise during operation, and generates heat of a high temperature through the rotor rotated at a high speed, thus requiring measures to solve these problems.

SUMMARY OF THE INVENTION

Accordingly, the present invention is directed to a vacuum pump for vehicles.

An object of the present invention is to provide a vacuum pump for vehicles which minimizes noise generated therefrom.

Another object of the present invention is to provide a vacuum pump for vehicles which reduces both noise and heat generated during operation of the vacuum pump.

To achieve this object and other advantages and in accordance with the purpose of the invention, as embodied and broadly described herein, a vacuum pump for vehicles includes a motor housing provided with an air inlet through which air is sucked, a pump unit disposed on the motor housing to generate a vacuum using the air sucked through the air inlet, and a chamber unit, the inside of which is divided, disposed on the pump unit.

The chamber unit may include an inner cap to cover the upper portion of the pump unit, and an outer cap to cover the upper portion of the inner cap.

The inner cap and the outer cap may be made of different materials.

The inner cap may be made of aluminum, and the outer cap may be made of any one of plastic and stainless steel.

The inner cap and the outer cap may be communicated with each other.

The inner cap may include at least one opening to move exhaust air generated from the pump unit to the outer cap.

The at least one opening may include a center hole formed at the center of the inner cap, and side holes separated from each other in the circumferential direction of the upper surface of the inner cap.

The outer cap may include support ribs disposed concentrically around the center of the inner surface of the outer cap.

The outer cap may further include connection members to connect the support ribs at a regular interval.

The inner cap may be disposed to have one separation distance from the outer surface of the pump unit, and the outer cap may be disposed to have another separation distance from the outer surface of the inner cap.

The vacuum pump for vehicles may further include a packing member between the pump unit and the motor housing to reduce vibration and to prevent air leakage.

The motor housing may include alignment members separated from each other at the same interval on the upper surface of the motor housing to achieve positional alignment of the pump unit.

Each of the alignment members may include a first guide part rounded toward the center of the motor housing, and a second guide part bent with facing the outside of the motor housing.

In another aspect of the present invention, a vacuum pump for vehicles includes a motor housing provided with an air inlet through which air is sucked, a pump unit disposed on the motor housing to generate a vacuum using the air sucked through the air inlet, and a chamber unit disposed on the pump unit to reduce both noise and heat generated during operation of the pump unit.

The pump unit may include a rotor unit rotated by driving force generated from a motor, a cam ring into which the rotor unit is inserted, a base plate installed under the cam ring, and provided with a suction hole and a discharge hole, and an upper plate installed on the cam ring to cover the upper surface of the rotor unit.

The cam ring may include heat radiating protrusions to radiate heat generated during rotation of the rotor, and the heat radiated through the cam ring may be mixed with exhaust air exhausted through the discharge hole and then be discharged to the outside of the vacuum pump.

The motor housing may include a cap, with which a controller to control the motor is integrated, mounted on the lower portion of the motor housing.

The cap may include an upper region, in which first electronic elements are disposed, provided in an upper area centering around the controller, and a lower region, in which second electronic elements operated at a higher-temperature state than the first electronic elements are disposed, provided in a lower area centering around on the controller.

The cap may further include an open hole provided with an opened lower surface.

The controller may radiate heat generated during operation of the controller through the inside and outside of the cap.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, preferred embodiments of the present invention will be described in detail with reference to the accompanying drawings.

Figure 1:
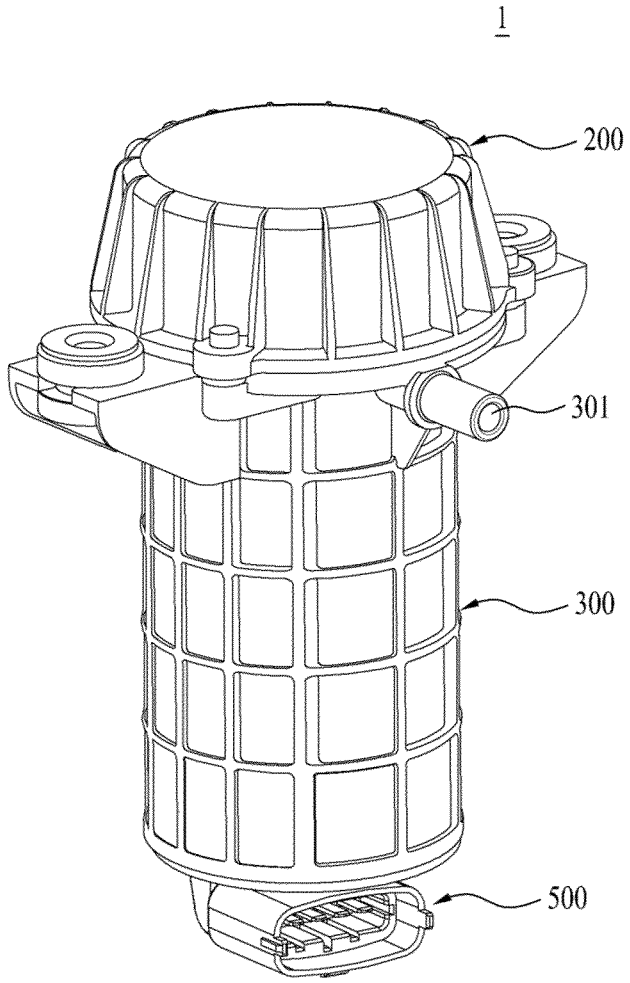
FIG. 1 is a perspective view illustrating a vacuum pump for vehicles in accordance with one embodiment of the present invention.
Figure 2:
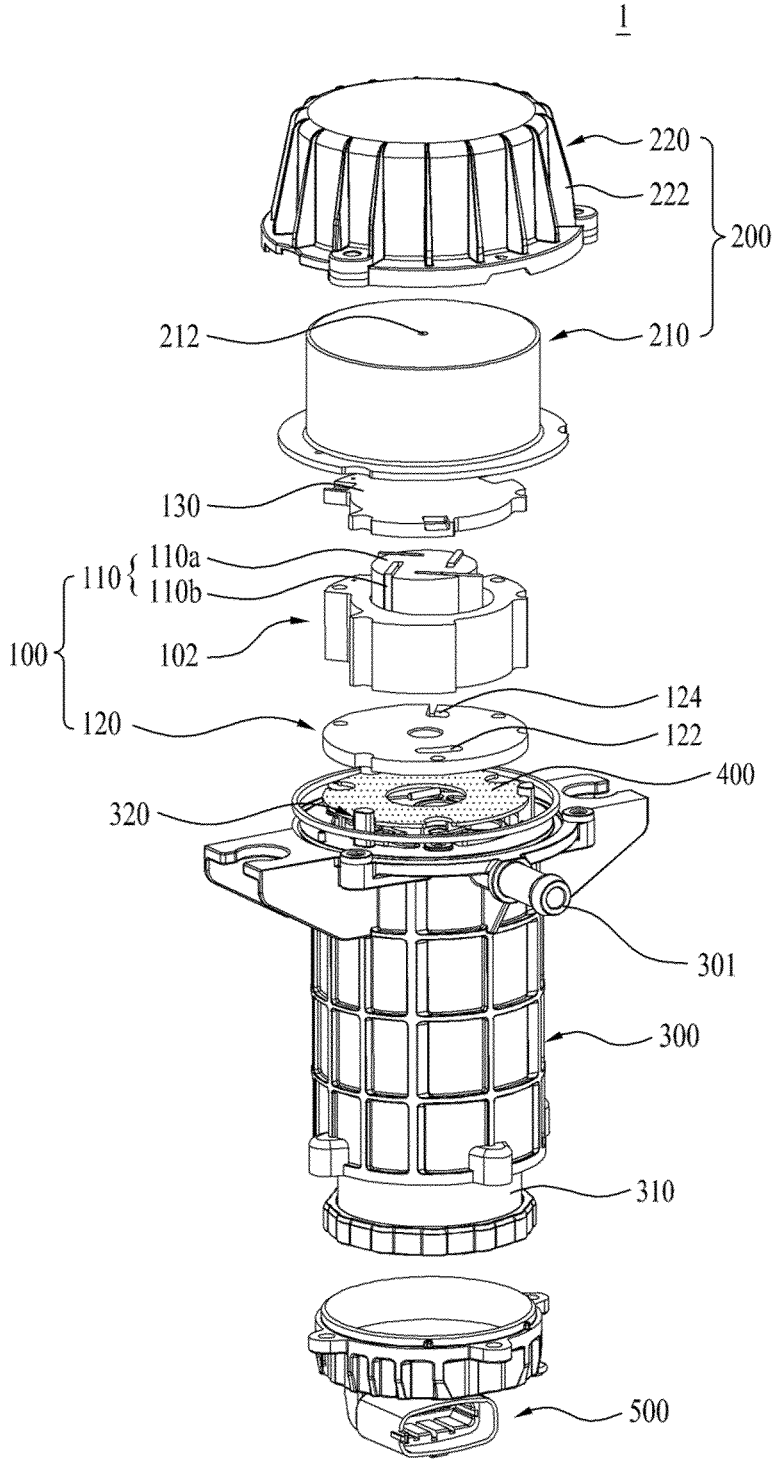
FIG. 2 is an exploded perspective view of the vacuum pump for vehicles in accordance with the embodiment of the present invention.

With reference to FIGS. 1 and 2, a main constitution of a vacuum pump for vehicles in accordance with one embodiment of the present invention will be described.

The vacuum pump 1 includes a motor housing 300 into which a motor 310 (with reference to FIG. 2) is inserted. Preferably, the motor housing 300 has a cylindrical shape such that the motor 310 is easily inserted into the motor housing 300.

A pump unit 100 (with reference to FIG. 2) is disposed on the motor housing 300, and a chamber unit 200 is disposed on the pump unit 100. Preferably, the pump unit 100 is received in the chamber unit 200, and is fixed to the upper surface of the motor housing 200.

The motor housing 300 is provided with an air inlet 301 formed at the upper portion thereof to suck air within a brake booster (not shown).

A separate tube (not shown) for smooth air suction is installed between the air inlet 301 and the brake booster.

With reference to FIG. 2, the pump unit 100 includes a rotor unit 110, a base plate 120, and an upper plate 130.

The rotor unit 110 includes a rotor 110*a* rotated within a cam ring 102, and vanes 110*b* inserted into slots provided on the rotor 110*a*.

That is, the cam ring 102 is basically formed in a ring shape, and includes grooves partially coming into the cam ring 102 along the outer circumference of the cam ring 102.

The grooves are provided on the outer circumferential surface of the cam ring 102 to slim the cam ring 102 to minimize generation of unnecessary weight, and serve to provide a heat radiation space due to operation of the rotor 110*a*.

Preferably, a motor shaft (not shown) provided on the motor 310 is connected to an insertion hole provided through the center of the rotor 110*a*, and rotation of the rotor 110*a* is achieved by rotation of the motor shaft.

The rotor 110*a* may be inserted into the cam ring 102. Preferably, a cam ring hole formed through the center of the cam ring 102 is disposed to a specific position such that the rotor 110*a* may be eccentrically rotated in the cam ring 102.

The upper plate 130 is closely adhered to the upper surface of the cam ring 102, and the base plate 120 is disposed on the lower surface of the cam ring 102.

The base plate 120 includes a suction hole 122 through which air introduced through the air inlet 301 is sucked, and a discharge hole 124, through which air compressed by the rotor 110*a* is exhausted, located at a position opposite to the suction hole 122.

Preferably, the upper plate 130 is closely adhered to the upper surface of the rotor unit 110.

Further, preferably, the upper plate 130 is mounted on the cam ring 102 such that the rotor 110*a* is stably rotated regardless of high-speed rotation of the rotor 110*a*.

Figure 3:
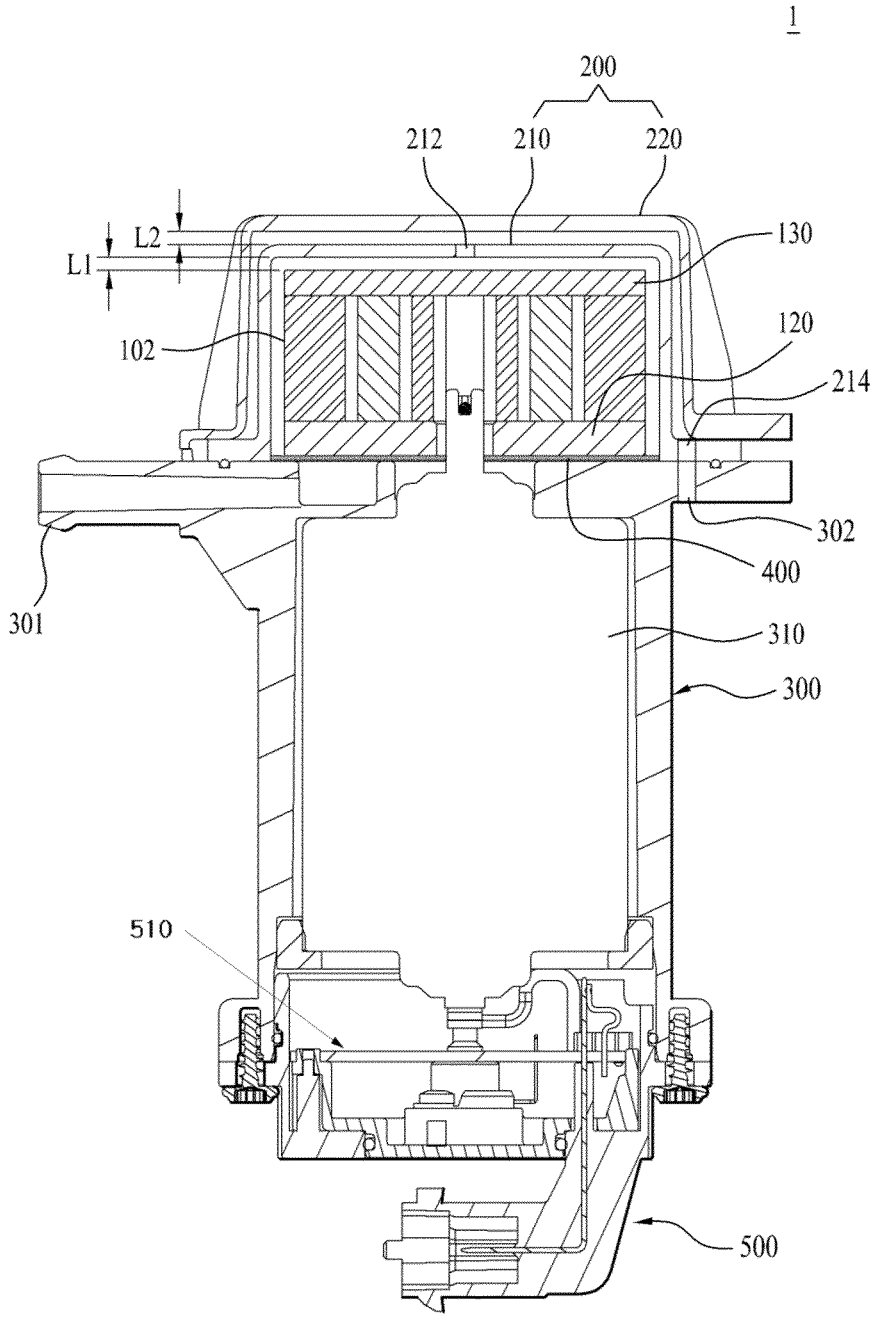
FIG. 3 is a longitudinal-sectional view of the vacuum pump for vehicles in accordance with the embodiment of the present invention.

Now, the chamber unit in accordance with the embodiment of the present invention will be described with reference to FIGS. 2 and 3.

The chamber unit 200 is provided to reduce noise caused by a pressure variation generated due to air suction and exhaust by rotation of the cam ring 102.

For this purpose, the chamber unit 200 includes an inner cap 210 to cover the upper portion of the pump unit 100, and an outer cap 220 to cover the upper portion of the inner cap 210.

Preferably, the inner cap 210 and the outer cap 220 are disposed so as to be communicated with each other. That is, it is preferable that air exhausted to the inner cap 210 moves toward the outer cap 220.

The inner cap 210 and the outer cap 220 may be made of the same material, or different materials.

If the inner cap 210 and the outer cap 220 are made of different materials, the inner cap 210 and the outer cap 220 are respectively made of any one of plastic, aluminum, and stainless steel.

It is preferable that the inner cap 210 is made of aluminum and the outer cap 220 is made of stainless steel or plastic in terms of noise reduction.

That is, it is advantageous for the inner cap 210 to be made of aluminum which is scarcely vibrated according to a pressure variation of exhaust air, and it is advantageous for the outer cap 220 to be made of a hard material, such as stainless steel or plastic, in terms of noise reduction.

Separation distances L1 and L2 provided on the chamber unit in accordance with the embodiment of the present invention will be described with reference to FIG. 3.

The inner cap 210 is separated from the upper surface of the upper plate 130 by a separation distance L1. The separation distance L1 corresponds to a separation distance between the upper surface of the upper plate 130 and the inner surface of the inner cap 210.

The separation distance L1 is not limited to a specific value. However, it is preferable that the separation distance L1 is about 2 mm in order to stably move air.

Further, the outer cap 220 is separated from the outer surface of the inner cap 210 by a separation distance L2. The separation distances L1 and L2 correspond to a kind of passage to discharge exhaust air to the outside of the vacuum pump 1.

The vacuum pump 1 further includes a packing member 400 provided on the lower surface of the pump unit 100 to reduce vibration generated from operation of the pump unit 100 and to prevent leakage of high-pressure exhaust air.

The packing member 400 is compressed to be 30% or more of an initial thickness thereof when the pump unit 100 is installed on the motor housing 300, and is interposed between the pump unit 100 and the motor housing 300.

As described above, the packing member 400 located on the lower surface of the pump unit 100 serves as both a damper and a seal.

The packing member 400 includes a packing hole communicated with the suction hole 122.

Now, a cap connected with the motor housing in accordance with the embodiment of the present invention will be described with reference to FIG. 3.

A cap 500, with which a controller 510 to control the motor 310 is integrated, is mounted on the lower portion of the motor housing 300.

The controller 510 is provided to control operation of the motor 310. Here, the controller 510 is not disposed separately from the vacuum pump 1, but is integrated with the vacuum pump 1.

The above controller-integrated type vacuum pump greatly improves ease, efficiency, and responsiveness in control, and simultaneously improves commercial value, compared with a conventional vacuum pump.

Figure 4:
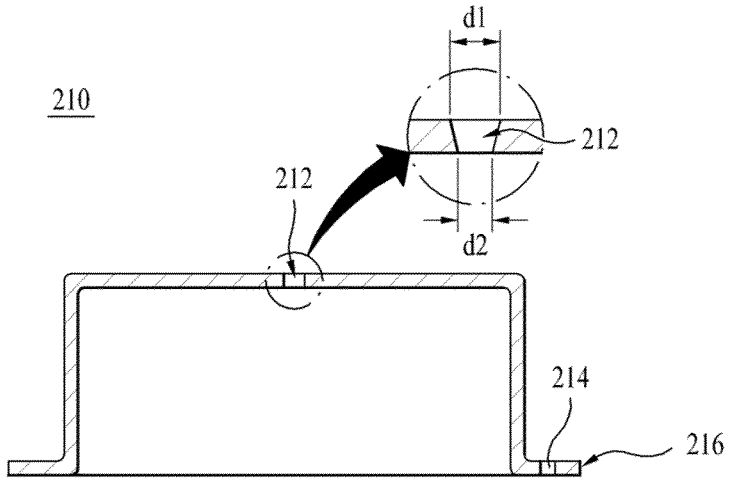
FIGS. 4 to 7 are longitudinal-sectional views illustrating various inner caps in accordance with embodiments of the present invention.

Now, an opening in accordance with one embodiment of the present invention will be described with reference to FIG. 4.

An opening 212 through which air exhausted through the discharge hole 124 moves to the outer cap 220 is formed through the center of the inner cap 210.

The opening 212 is formed at different diameters. That is, if an upper diameter of the opening 212 is defined as d1 and a lower diameter of the opening 212 is defined as d2, d1 is greater than d2.

It is preferable that the opening 212 is independently disposed at the center of the inner cap 210. However, the opening 212 is not limited thereto.

Figure 5:
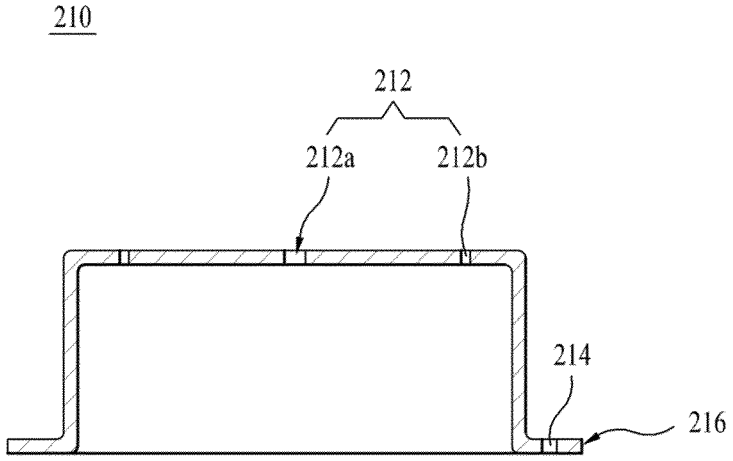

Next, openings in accordance with another embodiment of the present invention will be described with reference to FIG. 5.

Openings 212 include a center hole 212*a* provided at the center of the inner cap 210, and side holes 212*b* disposed in the circumferential direction of the upper surface of the inner cap 210.

Plural side holes 212*b* are separated from each other at the same interval, and the diameter of the side holes 212*b* is smaller than the diameter of the center hole 212*a*.

Most of the exhaust air passing through the discharge hole 124 moves to the outer cap 220 through the center hole 212*a*, and only a small amount of the exhaust air moves through the side holes 212*b*, thereby achieving diffusion of the exhaust air within the inner cap 210 and noise reduction due to delay, simultaneously.

Figure 6:
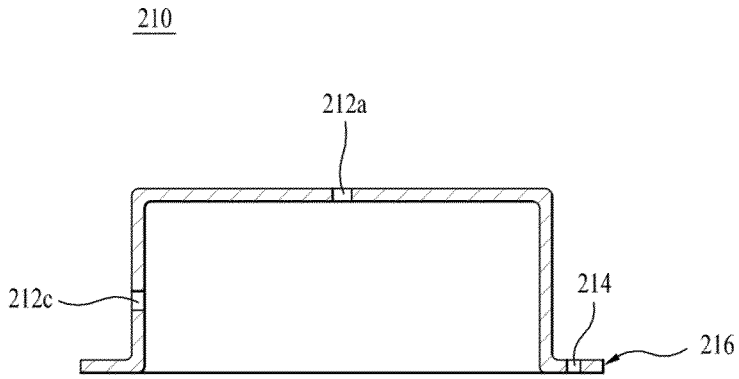

Next, openings in accordance with a further embodiment of the present invention will be described with reference to FIG. 6.

Openings 212 include a center hole 212*a* provided at the center of the inner cap 210, and sub-holes 212*c* disposed on a bent surface of the inner cap 210 bent to the outside of the inner cap 210.

The sub-holes 212*c* are provided to move air through the side surface of the inner cap 210, and serve to reduce both high-frequency noise and low-frequency noise of the exhaust air, thereby rapidly achieving noise reduction.

Figure 7:
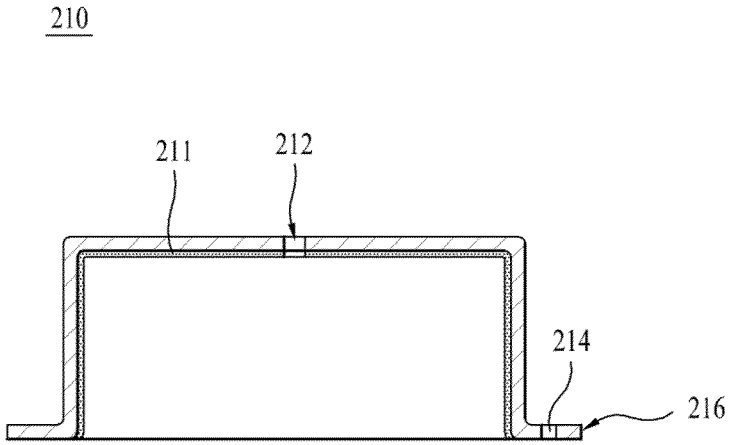

Now, a through hole in accordance with the embodiment of the present invention will be described with reference to FIG. 7.

In order to fix the inner cap 210 to the upper surface of the motor housing 300, a through hole 214 is provided on a flange 216 perpendicularly bent to the outside of the inner cap 210. It is preferable that the through hole 214 is communicated with an exhaust hole 302 (with reference to FIG. 13) provided on the motor housing 300, which will be described later, and air is exhausted to the outside of the vacuum pump 1 through the through hole 214.

Now, a sound-absorbing layer in accordance with the embodiment of the present invention will be described with reference to FIG. 7.

A sound-absorbing layer 211 to reduce noise of the exhaust air is provided on the inner surface of the inner cap 210.

It is preferable that the sound-absorbing layer 211 is made of a porous foaming material or materials having similar characteristics to the foaming material. However, the material of the sound-absorbing layer 211 is not limited thereto.

Figure 8:
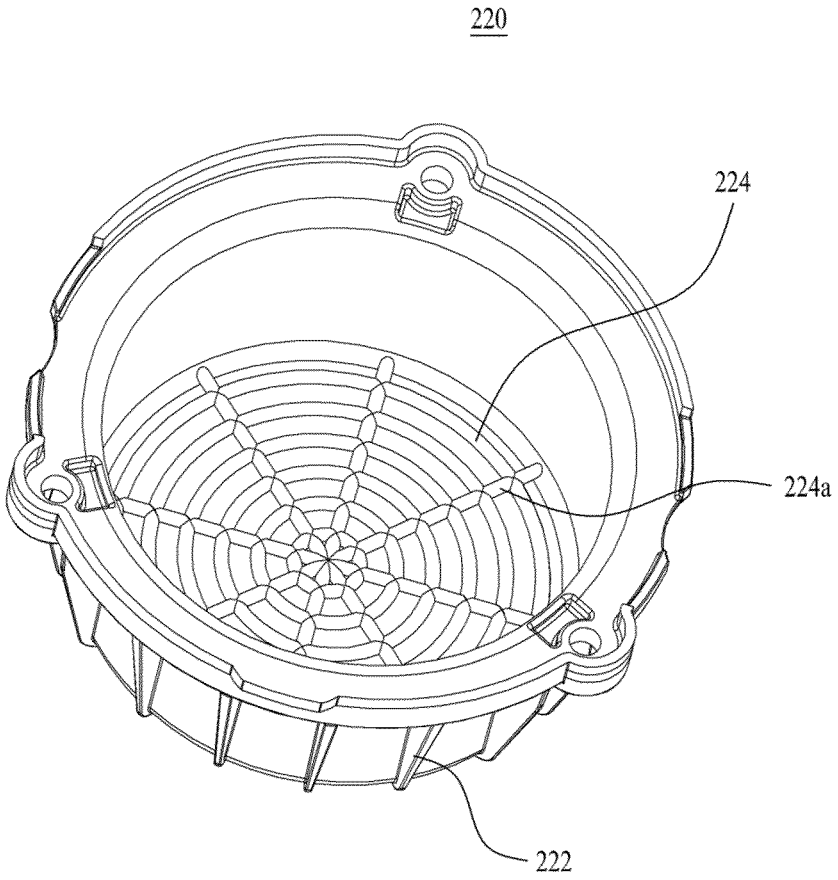
FIG. 8 is a perspective view of an outer cap of the vacuum pump for vehicles in accordance with the embodiment of the present invention.
Figure 9:
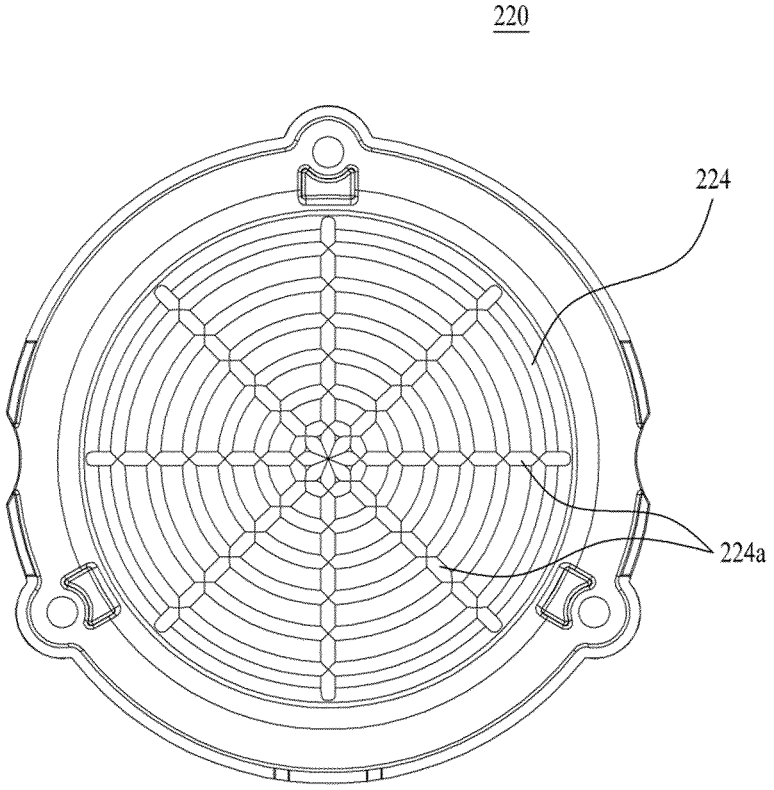
FIG. 9 is a view illustrating the inside of the outer cap of the vacuum pump for vehicles in accordance with the embodiment of the present invention.

Now, the outer cap in accordance with the embodiment of the present invention will be described with reference to FIGS. 8 and 9.

The outer cap 220 includes support ribs 224 protruded outwardly from the inner surface of the outer cap 220 concentrically around the center of the outer cap 220.

Plural support ribs 224 are respectively formed in the shape of circles having different diameters, and are disposed on the inner surface of the outer cap 220 at the same interval. The support ribs 224 serves to reinforce the structural rigidity of the outer cap 220, if the outer cap 220 is made of plastic, and to prevent excitation of the upper surface of the outer cap 220 by pressure of the exhaust air.

That is, the inner upper surface of the outer cap 220 is vibrated by the exhaust air introduced into the outer cap 220 through the openings 212, and the support ribs 224 prevent the vibration of the outer cap 220.

The outer cap 220 further includes connection members 224*a* to interconnect the support ribs 224 at a regular interval.

The connection members 224*a* may be disposed in a cross shape around the center of the inner surface of the outer cap 220, or be disposed in other shapes obtained by adding lines to the cross shape.

Here, it is preferable that the connection members 224*a* divide all regions of the support ribs 224 of the outer cap 220 at the same interval in order to support and reinforce the support ribs 224.

The outer cap 220 further includes reinforcing members 222 provided on the outer surface of the outer cap 220 to reinforce the rigidity of the outer cap 220 together with the support ribs 224. The reinforcing members 220 are disposed at the same interval along the outer circumferential surface of the outer cap 220.

The reinforcing members 222 in a plate shape are protruded from the outer surface of the outer cap 220.

Figure 10:
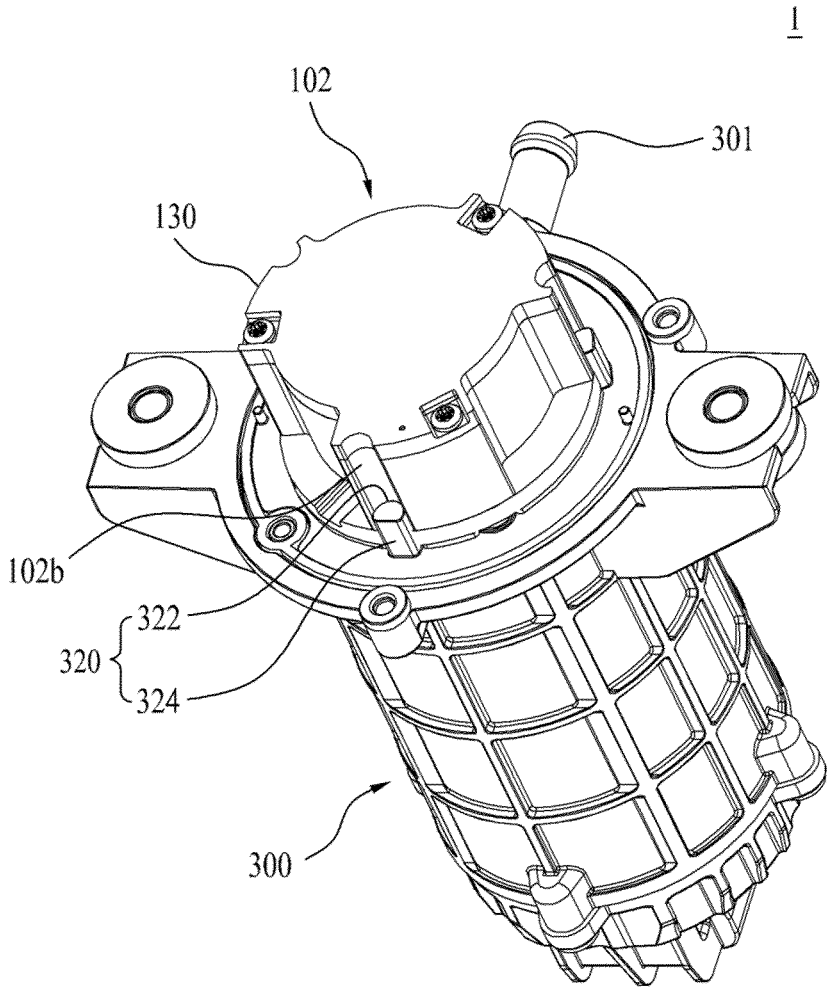
FIG. 10 is a perspective view illustrating a connection state of a cam ring to alignment members provided on the vacuum pump for vehicles in accordance with the embodiment of the present invention.
Figure 11:
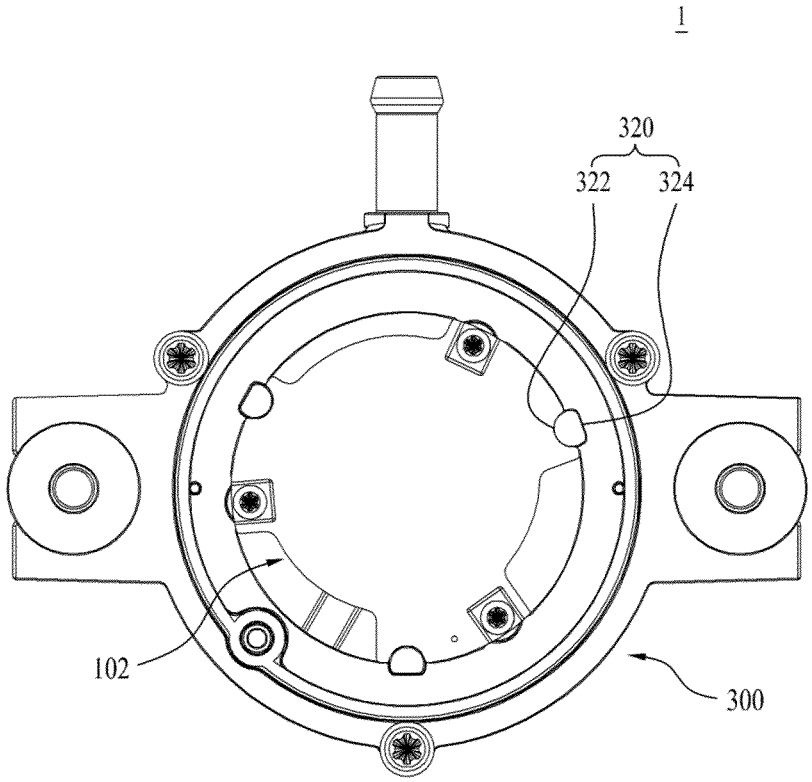
FIG. 11 is a plan view of FIG. 10.

Now, alignment members provided on the vacuum pump for vehicles in accordance with the embodiment of the present invention will be described with reference to FIGS. 10 and 11.

Alignment members 320 are separated from each other at the same interval along the edge of the upper surface of the motor housing 300 so as to align the position of the pump unit 100.

It is preferable that the alignment members 320 are protruded toward the upper surface of the motor housing 300 by a designated length.

The alignment members 320 serve to stably connect the motor housing 300 with the cam ring 102, which will be described later, and to fix the cam ring 102.

Further, it is preferable that the alignment members 320 are manufactured integrally with the motor housing 300 by injection molding.

Each of the alignment members 320 includes first and second guide parts 322 and 324.

The first guide part 322 is rounded toward the center of the upper surface of the motor housing 300.

The second guide part 324 is bent with facing the outside of the motor housing 300. That is, the second guide part 324 does not directly contact the cam ring 102, and thus is formed in the shape of a surface, if it is seen from the outside.

It is preferable that the alignment members 320 are tilted outwardly from the upper portions thereof to the lower portions thereof.

Such a structure serves to improve fixing force through interference fit when the motor housing 300 is connected to the cam ring 102.

It is preferable that grooves 102*b* are formed on the cam ring 102 at positions corresponding to the alignment members 320.

Preferably, the grooves 102*b* are formed to maintain the same diameter in order to stably maintain interference fit when the grooves 102*b* and the alignment members 320 are connected.

When the rotor 110*a* is rotated at a high speed within the cam ring 102, the rotor 110*a* may generate vibration due to contact with the cam ring 102. The vibration induces positional movement of the cam ring 102, and the alignment members 320 prevent the movement of the cam ring 102.

Figure 12:
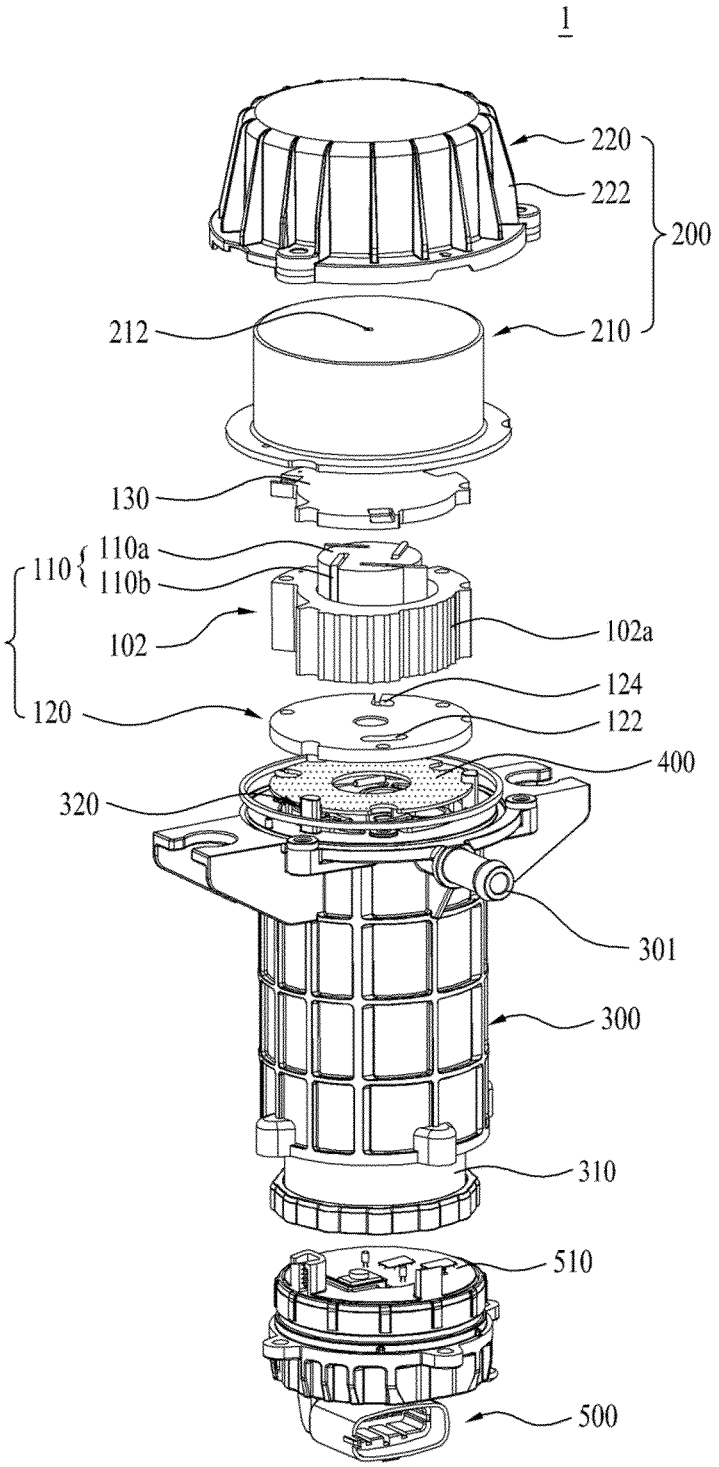
FIG. 12 is an exploded perspective view of a vacuum pump for vehicles in accordance with another embodiment of the present invention.

In order to solve problems of the vacuum pump due to generation of noise and heat, a vacuum pump in accordance with another embodiment of the present invention is provided. The vacuum pump in accordance with this embodiment will be described with reference to FIG. 12.

A vacuum pump 1 in accordance with this embodiment includes a motor housing 3000, a pump unit 100, and a chamber unit 200 to cover the upper portion of the pump unit 100.

The motor housing 300 and the pump unit 100 in accordance with this embodiment are the same as those in accordance with the earlier embodiment, and thus a detailed description thereof will be omitted.

A cam ring 102 disposed within the pump unit 100 includes a plurality of heat radiating protrusions 102*a* formed on the outer surface of the cam ring 102. The heat radiating protrusions 102*a* are disposed on the outer circumferential surface of the cam ring 102, and are not limited to the shape or configuration shown in FIG. 12.

The heat radiating protrusions 102*a* are provided to radiate heat generated by friction of the rotor 110*a* with the inner circumferential surface of the cam ring 102 during operation of the rotor 110*a*. Further, the heat radiating protrusions 102*a* increase the surface area of the cam ring 102, thereby maximally assuring a heat radiating area of the cam ring 102.

Figure 13:
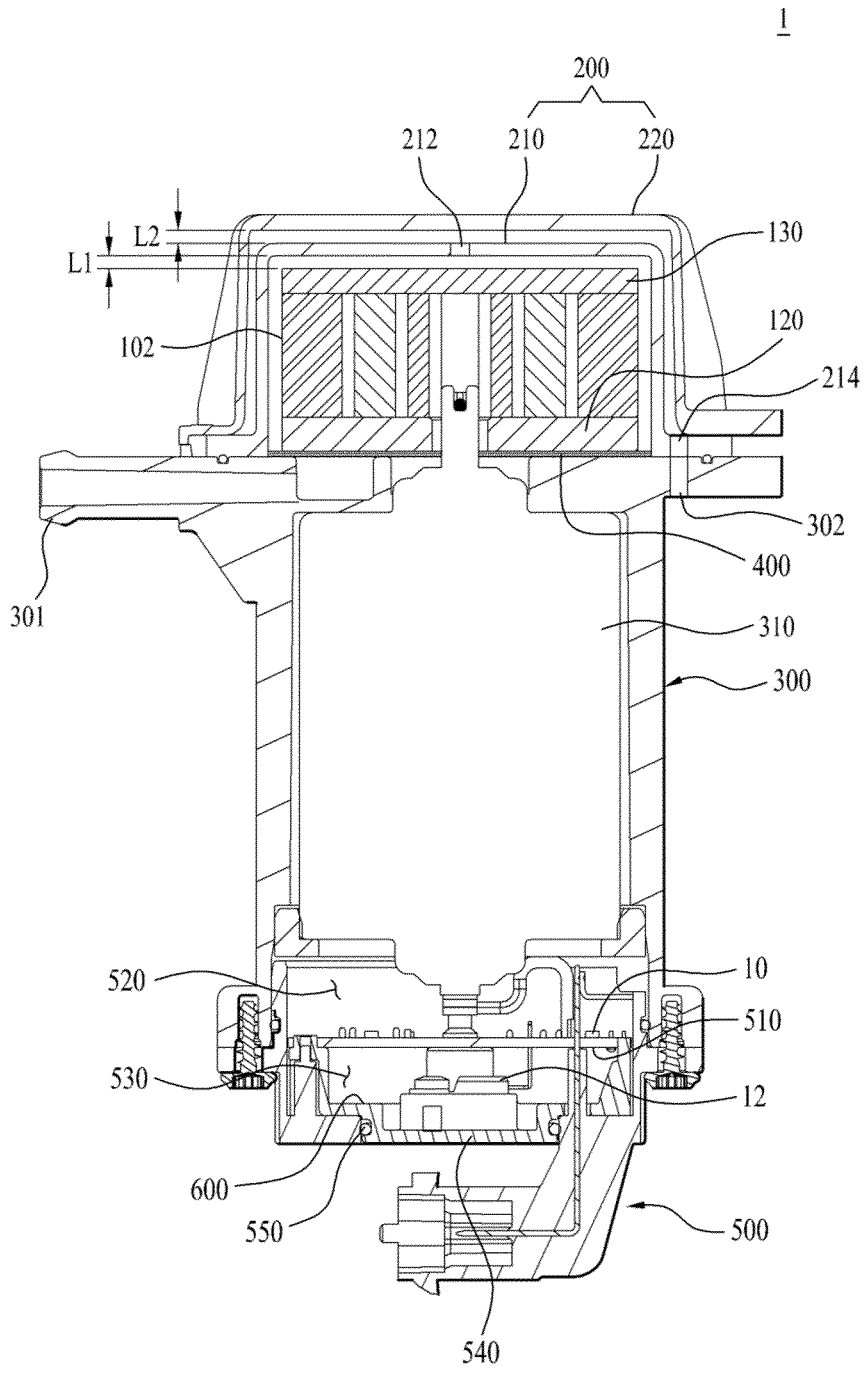
FIG. 13 is a longitudinal-sectional view of FIG. 12.
Figure 14:
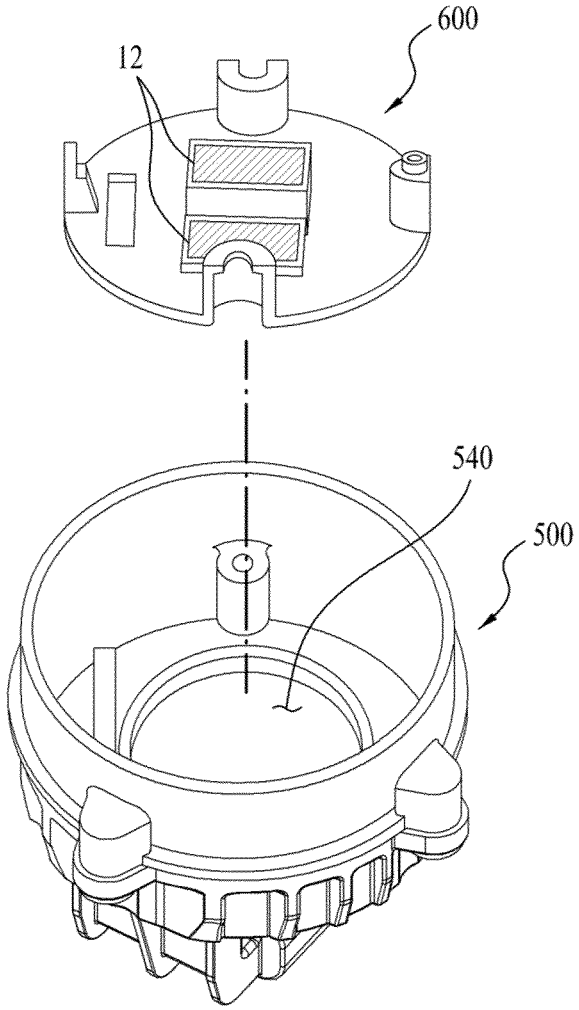
FIG. 14 is a perspective view illustrating a cap and a heat radiating member provided on the vacuum pump for vehicles in accordance with the embodiment of the present invention.

Now, a cap in accordance with this embodiment of the present invention will be described with reference to FIGS. 13 and 14.

The vacuum pump 1 further includes a cap 500 with which a controller 510 to control the motor 310 is integrated and which is mounted on the lower portion of the motor housing 300.

The cap 500 is provided with a socket provided on the lower portion thereof to receive power supplied from a power supply device (not shown).

The inner area of the cap 500 is divided into upper and lower regions 520 and 530 independently disposed centering around the controller 510 on which first electronic elements 10 are disposed.

That is, the upper region 520 is disposed in an upper area of the cap 500 centering around the controller 510, and a lower region 530 in which second electronic elements 12 are disposed is disposed in a lower area of the cap 500 centering around the controller 510.

The second electronic elements 12 are operated with generating heat of a relatively high temperature, compared with the first electronic elements 12. That is, a field-effect transistor (FET) is installed as the second electronic element 12.

The second electronic element 12 is an electronic element which generates heat of a high temperature of 150° C. or more during operation, and the first electronic element 10 is an electronic element which generates heat of a temperature of about 120° C. during operation.

The cap 500 further includes an open hole 540 provided with an opened lower surface.

It is preferable that heat generated from the controller 510 during operation is radiated through the inside and outside of the cap 500. Further, the heat may be radiated to the outside through the open hole 540.

The cap 500 includes a heat radiating member 600 provided within the cap 500 to receive heat generated from the second electronic elements 12 through conduction.

The heat radiating member 600 is made of a material having high heat conductivity. For example, the heat radiating member 600 is preferably made of one selected from the group consisting of aluminum, copper, and silver (Ag).

The heat radiating member 600 is installed on the upper surface of the open hole 540. Such a position of the heat radiating member 600 functions to rapidly radiate heat generated from the second electronic elements 12 to the outside of the open hole 540 when the second electronic elements 12 are operated.

It is preferable that the second electronic elements 12 are disposed on the heat radiating member 600 under the condition that the second electronic elements 12 are separated from each other.

If the second electronic elements 12 operated at a high temperature are disposed closely to each other, the second electronic elements 12 may be damaged by heat of a high temperature generated from the second electronic elements 12.

The heat radiating member 600 is disposed horizontally within the cap 500 so as to radiate heat upwardly and downwardly through the lower region 530 and the open hole 540.

Now, an operating state of the above vacuum pump for vehicles in accordance with the embodiment of the present invention will be described with reference to FIG. 15.

When a driver driving a vehicle on a road confirms braking of a front vehicle and thus steps on a brake pedal, the controller 510 transmits control instructions to generate braking force of a brake system provided on the vehicle to the motor 310.

Then, the motor shaft of the motor 310 is rotated, and thus the rotor 110*a* connected to the motor shaft is rotated in one direction.

The vanes 110*b* are rotated along the inner circumferential surface of the cam ring 102 by the rotation of the rotor 110*a*, and thereby air necessary to generate a vacuum is sucked through the air inlet 310.

As the rotor 110*a* is rotated at a high speed by the motor 310, air within a brake booster is introduced into the suction hole 122 via the air inlet 310 and is supplied to the inner area of the cam ring 102.

Simultaneously, close attachment of the vanes 110*b* to the inner circumferential surface of the cam ring 102 and separation of the vanes 110*b* from the inner circumferential surface of the cam ring 102 are repeated, thereby starting compression of the sucked air.

The compressed air is exhausted to the inner area of the inner cap 210 while maintaining a relatively high pressure, when the discharge hole 124 is opened by the rotor 110*a*, and moves along the upper surface of the upper plate 130.

The exhaust air moves in the circumferential direction of the inner cap 210 and the vertical direction (the upward direction), and finally moves through the openings 212.

Since the inner area of the inner cap 210 is greater than the opened area of the openings 212, noise of the exhaust air is diffused and reduced.

The separation distance L1 serves as a kind of passage to move the exhaust air to the openings 212, and stably promotes movement of the exhaust air to the opening 212.

If the separation distance L1 is excessively large, the exhaust air may cause resonance within the inner cap 210. Therefore, it is preferable that the separation distance L1, as shown in FIG. 15, is maintained.

The exhaust air generates turbulence within the inner cap 210. However, for convenience of description, it is described that the exhaust air moves in the circumferential direction of the inner cap 210 and the vertical direction (the upward direction).

The sound-absorbing layer 211 (with reference to FIG. 7) reduces noise generated by the air exhausted through the discharge hole 124, and thus reduces a portion of noise of the exhaust air moving to the outer cap 220.

Figure 15:
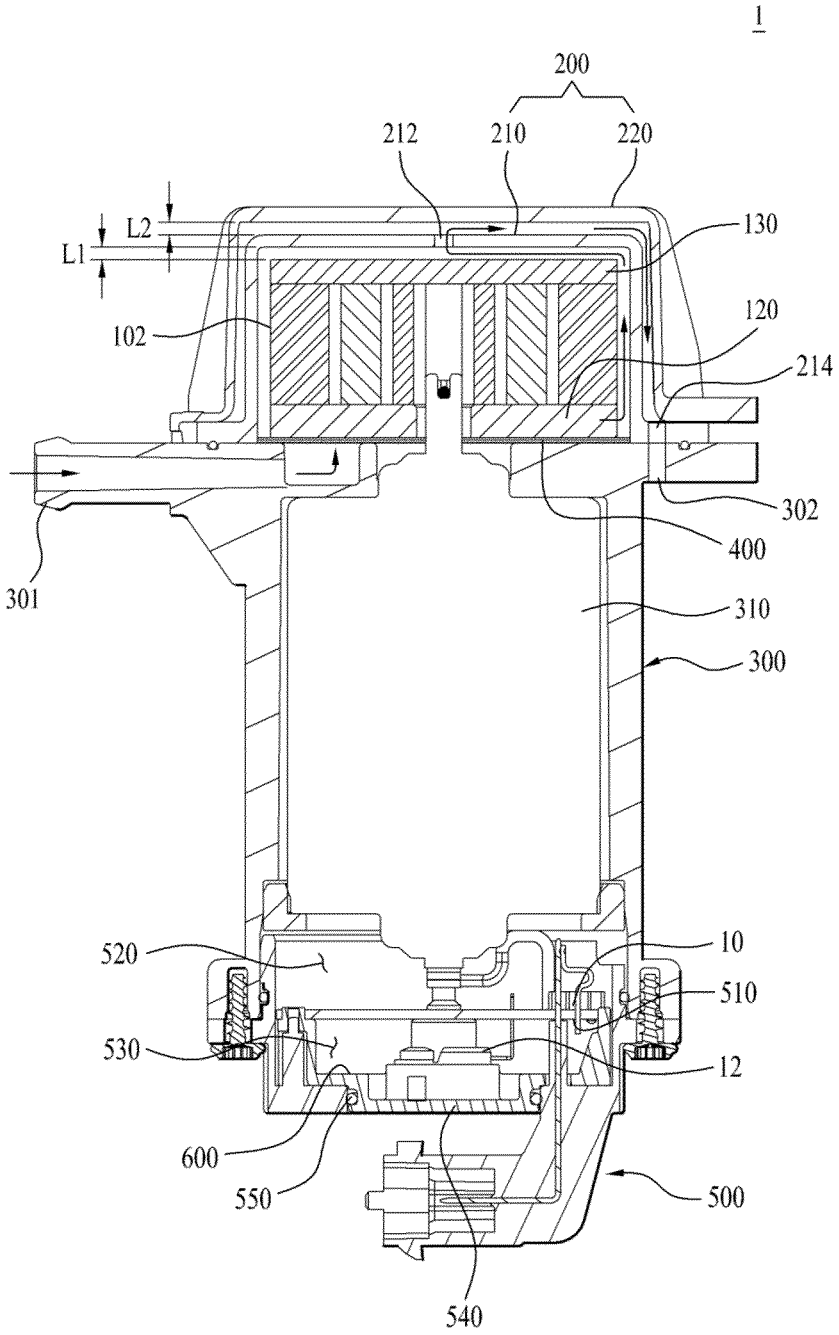
FIGS. 15 and 16 are views respectively illustrating operating states of vacuum pumps for vehicles in accordance with embodiments of the present invention.

Although not shown in FIG. 15, a flow of the exhaust air is achieved through the center hole 212*a* and the side holes 212*b*.

The side holes 212*b* more smoothly promote the flow of the exhaust air together with the center hole 212*a*.

Here, the diameter of the side holes 212*b* is smaller than the diameter of the center hole 212*a*, and thus most of the exhaust air is moved to the outer cap 220 through the center hole 212*a* and the remaining part of the exhaust air is moved to the outside of the inner cap 210 through the side holes 212*b*.

The exhaust air is moved to the inner area of the outer cap 220 via the openings 212.

The exhaust air is diffused and moved along the upper surface of the inner cap 210, and is moved to a space between downwardly bent parts of the inner cap 210 and the outer cap 220. At this time, noise of the exhaust air is reduced.

Here, the exhaust air is moved through the separation distance L2 between the inner cap 210 and the outer cap 220.

The exhaust air converts its direction into a direction toward the lower portion of the outer cap 220, and is exhausted to the outside of the vacuum pump 1 through the through hole 214 and the exhaust hole 302.

The vacuum pump 1 in accordance with the present invention generates vibration and noise when the rotor 110*a* is operated. The noise is reduced by the chamber unit 200, and the vibration is partially prevented by the packing member 400.

The packing member 400 is closely adhered to the lower surface of the base plate 120. The packing member 400 is interposed between the base plate 120 and the motor 300, and is installed in a compressed state in which the thickness of the packing member 400 is compressed from the initial state thereof.

The rotor unit 110 rotated at a high speed is disposed in the upper portion of the vacuum pump 1 centering round the packing member 400, and the motor 310 rotating the rotor unit 110 is disposed in the lower portion of the vacuum pump 1 centering around the packing member 400.

The rotor unit 110 and the motor 310 generate noise and vibration during operation, and thus function as factors to generate unnecessary noise in a vehicle provided with the vacuum pump 1.

Therefore, the packing member 400 prevents vibration generated from the rotor unit 110 from being transmitted to the motor 310, thereby reducing noise generation to a minimum.

Figure 16:
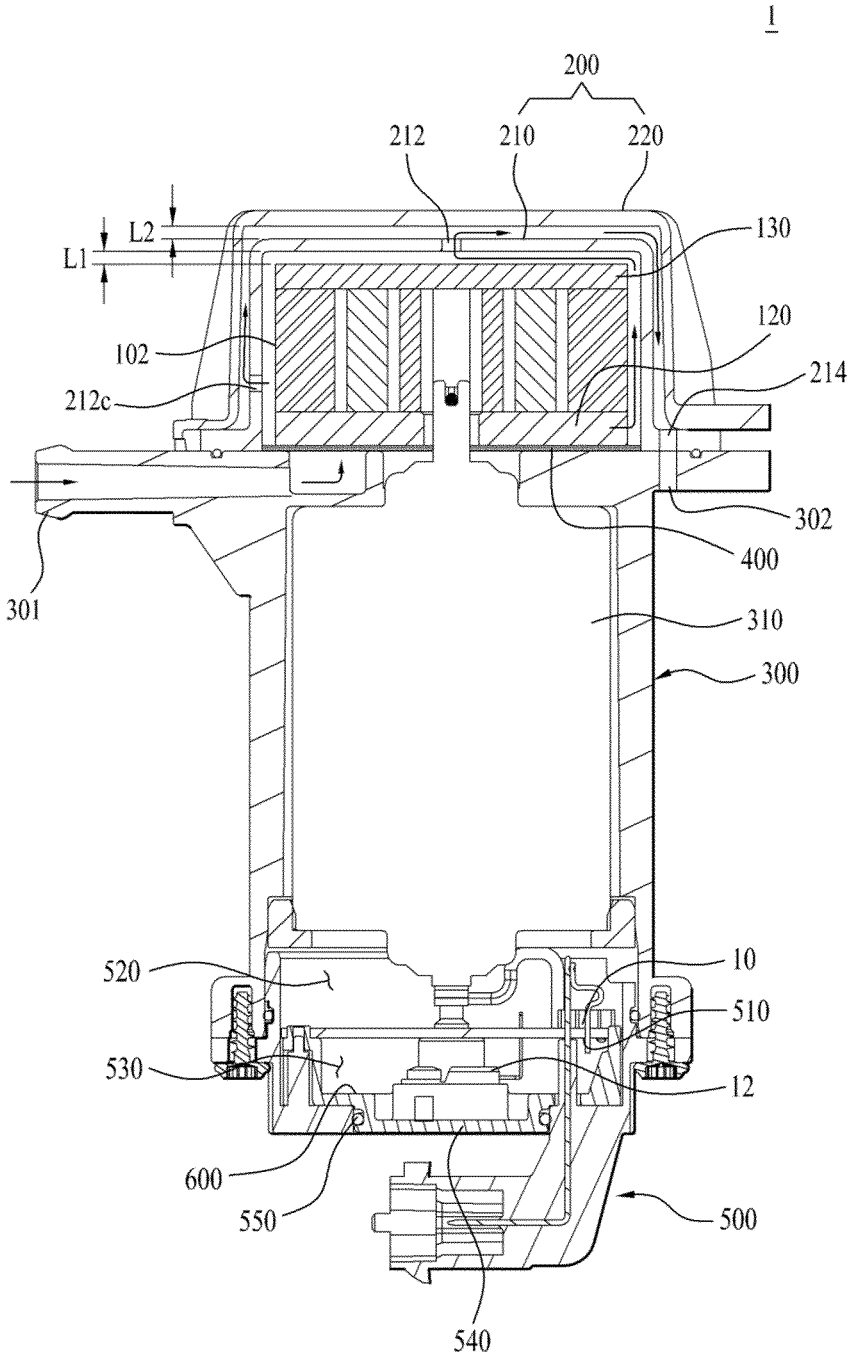

Now, a vacuum pump for vehicles in accordance with another embodiment of the present invention will be described with reference to FIG. 16.

A vacuum pump 1 achieves noise reduction through pressure equilibrium between high-frequency noise and low-frequency noise within a chamber unit 200.

Frictional noise generated due to friction of a rotor 110*a* rotated at a high speed with the inner circumferential surface of a cam ring 102 corresponds to the high-frequency noise, and the high-frequency noise is exhausted to an inner cap 210 through a discharge hole 124.

The high-frequency noise is moved upwardly by the internal shape of the inner cap 210, as shown by arrows, and simultaneously exhausted to the inside of an outer cap 220 through the sub-holes 212*c*.

The inner cap 210 generates high-frequency noise and low-frequency noise (in the region of the outer cap) centering around the sub-holes 212*c*. Pressure equilibrium is achieved by the sub-holes 212*c*, and the high-frequency noise is reduced by the inner cap 210 made of aluminum.

The low-frequency noise is reduced by the outer cap 220 made of stainless steel or plastic. Thereby, reduction of noise generated from the operation of the vacuum pump 1 is achieved.

Figure 17:
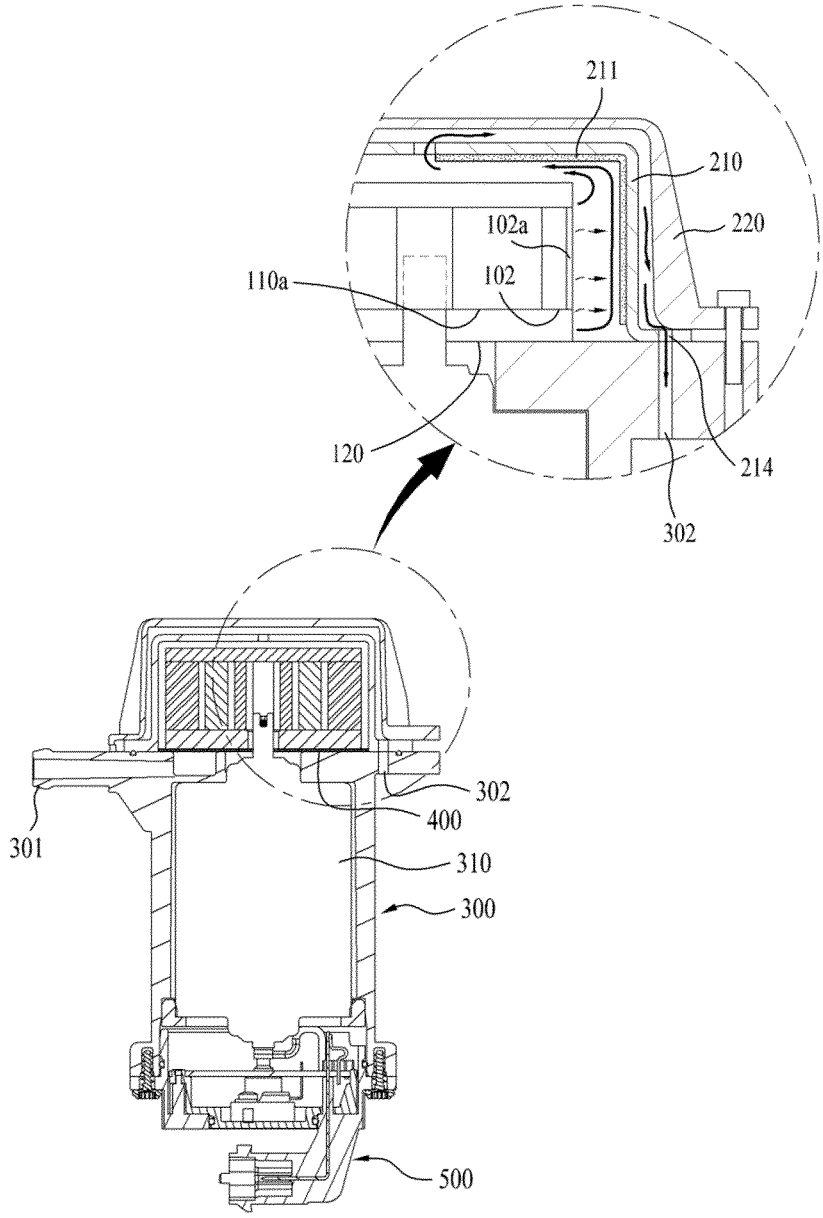
FIGS. 17 and 18 are view illustrating a heat radiating state of a chamber unit and the cap provided on the vacuum pump for vehicles in accordance with the present invention.

Now, a vacuum pump for vehicles in accordance with a further embodiment of the present invention will be described with reference to FIG. 17.

As a rotor 110*a* is rotated at a high speed, continuous friction between the inner circumferential surface of a cam ring 102 and vanes 110*b* occurs, thus generating heat.

The heat generated from the inner circumferential surface of the cam ring 102 is moved outwardly, and is radiated through the heat radiating protrusions 102*a*.

The heat radiating protrusions 102*a* are separated from each other at the same interval along the outer circumferential surface of the cam ring 102, and effectively radiate heat of a high temperature conducted through the inner circumferential surface of the cam ring 102 to the inner area of the inner cap 210.

The heat radiating protrusions 102*a* maintain an interval with the inner cap 210 through which exhaust air may be moved, and both the heat of the high temperature radiated from the heat radiating protrusions 102*a* and the exhaust air are simultaneously moved through the interval.

That is, the heat (expressed by a dotted line) of the high-temperature exhausted to the inside of the inner cap 210 through the heat radiating protrusions 102*a* is moved from the inner cap 210 to the outer cap 220 together with movement of the exhaust air (expressed by a solid line).

The exhaust air rapidly moves the heat of the high temperature radiated through the cam ring 102 to the outside of the vacuum pump 1 through the through hole 214 and the exhaust hole 302. Therefore, as the vacuum pump 1 is operated, heat radiation and noise reduction of the exhaust air are simultaneously achieved, thereby performing stable heat radiation according to the rotation of the rotor 110*a*.

Figure 18:
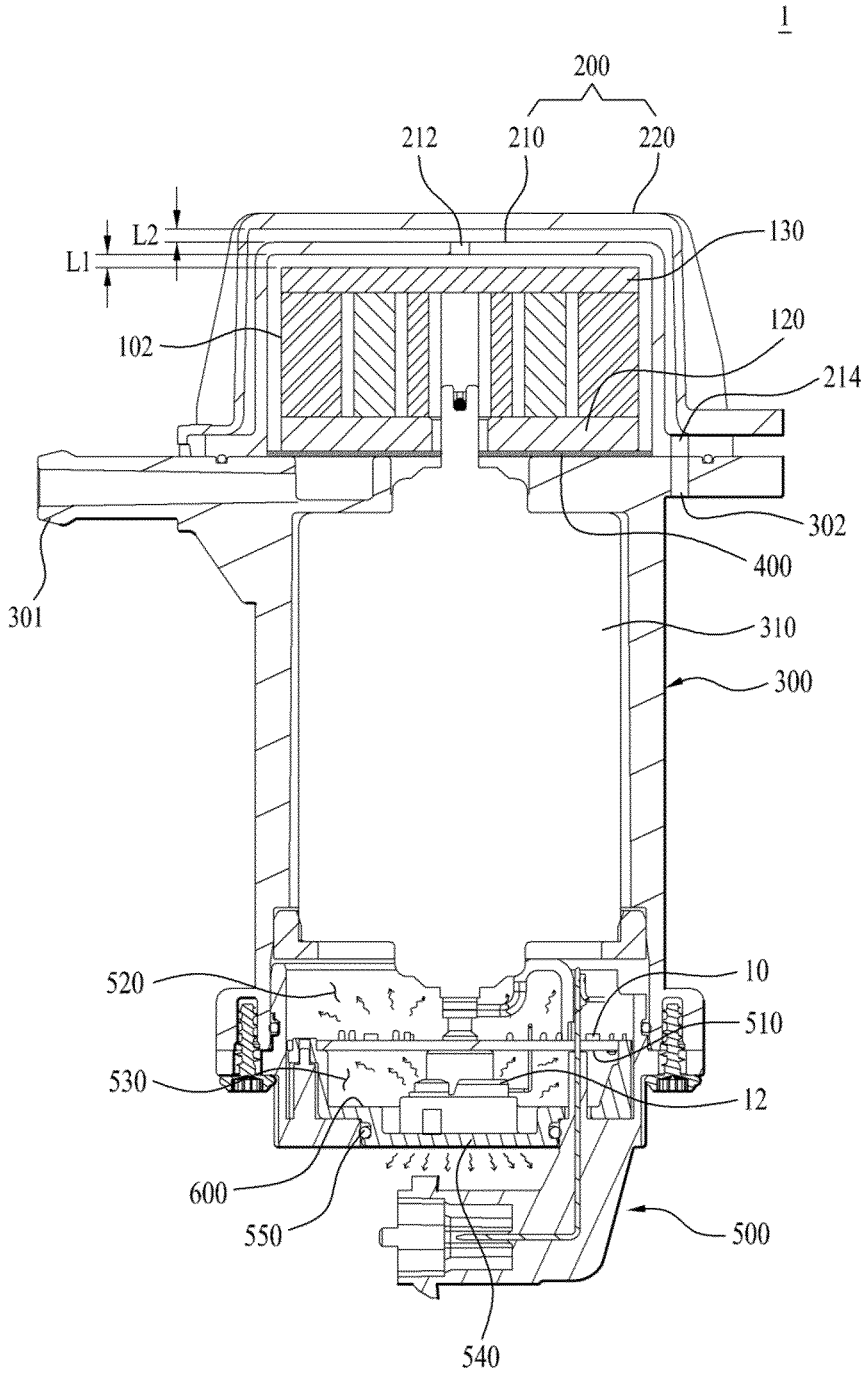

A heat radiating state in the cap will be described with reference to FIG. 18.

The controller 510 performs heat radiation of electronic elements mounted on the controller 510 while controlling an operating state of the vacuum pump 1.

Further, as heat in an engine room and heat generated from the first and second electronic elements 10 and 12 disposed in the controller 510 are added, the upper and lower regions 520 and 530 are heated close to critical operating temperatures of the first and second electronic elements 10 and 12.

Under the above state, heat radiation is independently carried out by the upper region 520 and the lower region 530 of the cap 500.

In more detail, heat generated from the first electronic elements 10 disposed on the controller 510 is radiated through the upper region 520, and is cooled by convection through the upper region 520.

Further, heat generated from the second electronic elements 12 is cooled by conduction through the heat radiating member 600.

The heat radiating member 600 is made of aluminum so as to more effectively achieve conduction of the heat generated from the second electronic elements 12, and thus the heat generated from the second electronic elements 12 is conducted to the outside of the motor housing 300 through the open hole 540.

The heat radiating member 600 is inserted into the open hole 540, thereby radiating heat through the open hole 540 in an air-cooling manner and radiating heat to the atmosphere through the lower region 530, simultaneously.

That is, the heat radiating member 600 radiates heat upwardly and downwardly through the lower region 530 and the open hole 540.

The second electronic elements 12 are separated from each other on the heat radiating member 600, thus being operated while minimizing heat conduction between the respective second electronic elements 12 during operation.

Further, since the second electronic elements 12 are disposed at positions having the shortest distance from the open hole 540, heat generated from the second electronic elements 12 is stably radiated through the open hole 540 simultaneously with heat generation from the second electronic elements 12.

Now, noise generation according to operations of a conventional vacuum pump and a vacuum pump in accordance with the present invention will be described with reference to FIGS. 19 and 20.

Figure 19:
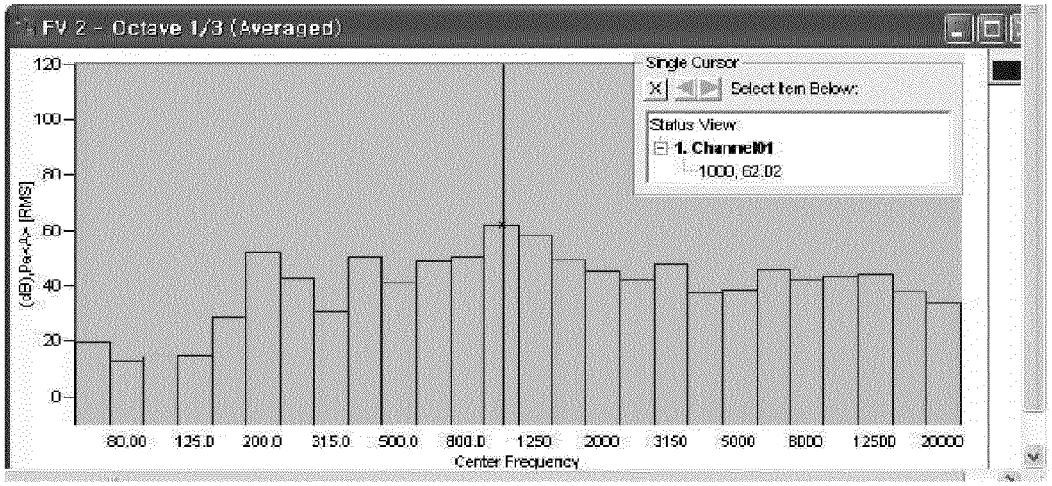
FIGS. 19 and 20 are graphs respectively illustrating noise generated from the vacuum pump for vehicles in accordance with the present invention and noise generated from a conventional vacuum pump.
Figure 20:
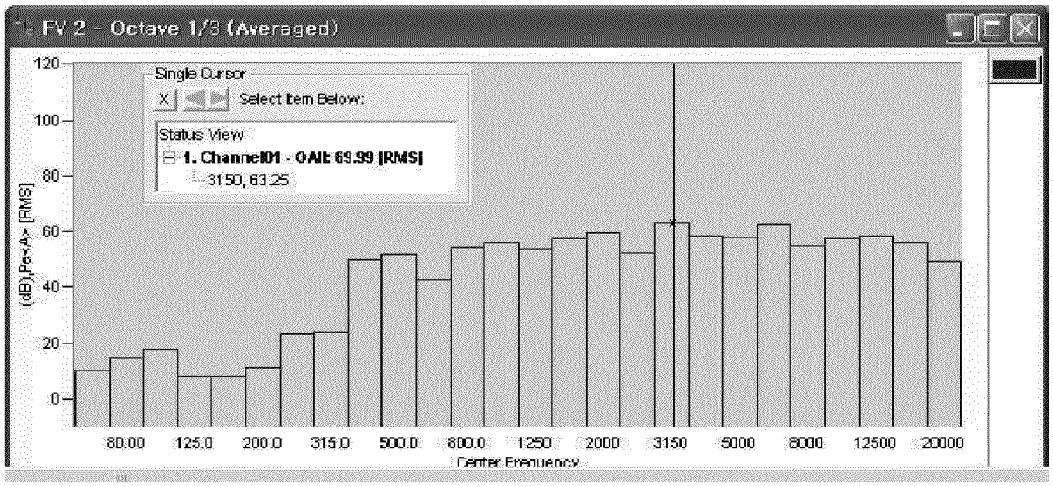

FIG. 19 is a graph illustrating noise generated during operation of the vacuum pump in accordance with the present invention, and FIG. 20 is a graph illustrating noise generated during operation of the conventional vacuum pump.

During a test, a sensor measures noise generated from the vacuum pump during operation of the vacuum pump under the condition that the sensor to measure noise of exhaust air is located at a position separated from the vacuum pump by a designated distance. For reference, the X-axis represents frequency, and the Y-axis represents decibels (db) to measure a noise value of exhaust air.

Particularly, noise at a high frequency of 1,000 Hz or more is considerably unpleasant to human listeners, and generation of such high-frequency noise may cause depreciation of a commercial value of a vehicle. Thus, reduction of the high-frequency noise is required.

It is understood that the vacuum pump in accordance with the present invention generates relatively little noise throughout all frequency bands compared with the conventional vacuum pump.

The conventional vacuum pump generates a noise value of 60 db or more at a frequency band of 2,000 Hz or more, but the vacuum pump in accordance with the present invention generates a noise value of about 45 db at the frequency band of 2,000 Hz or more. Therefore, it is understood that the vacuum pump in accordance with the present invention greatly reduces noise generation at a high frequency band compared with the conventional vacuum pump.

Accordingly, it is understood that the vacuum pump in accordance with the present invention reduces noise generation during operation compared with the conventional vacuum pump.

Next, pressure reducing states of the chamber units of the vacuum pumps in accordance with the embodiments of the present invention will be described with reference to FIGS. 21 to 23.

Figure 21:
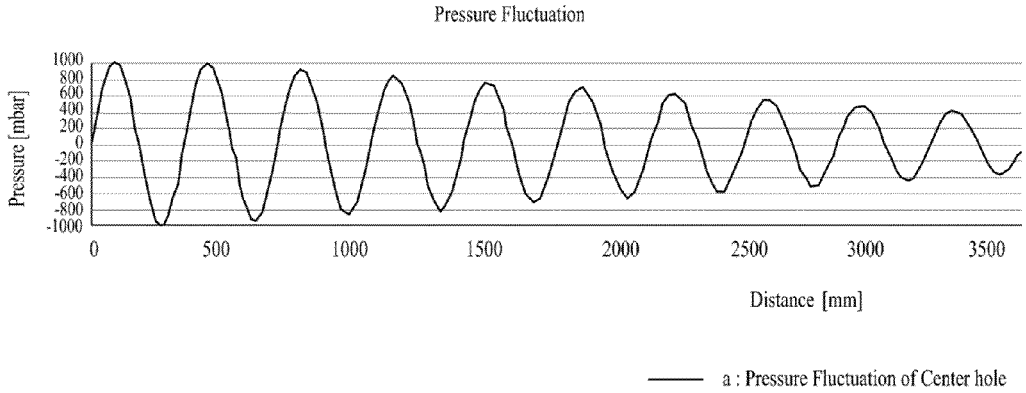
FIGS. 21 to 23 are graphs illustrating noise reducing states through chamber units of vacuum pumps for vehicles in accordance with embodiments of the present invention.
Figure 22:
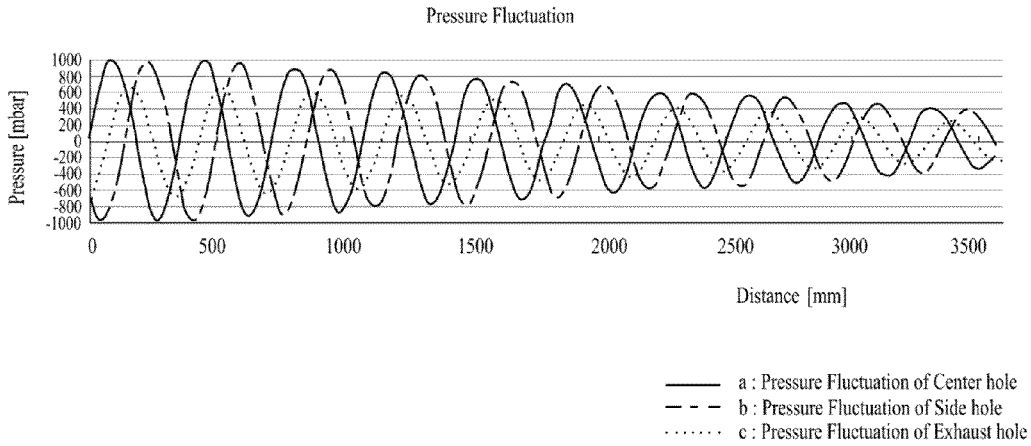
Figure 23:
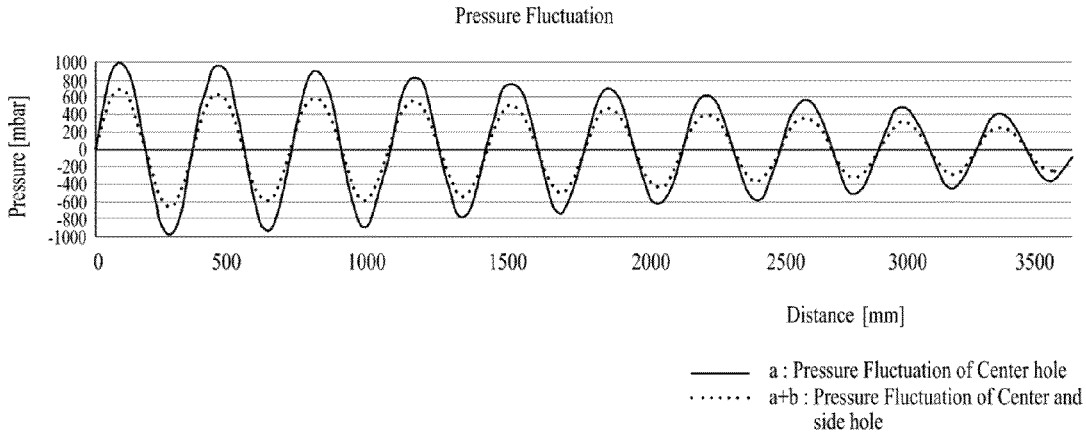

In FIGS. 21 to 23, a represents a curve illustrating pressure fluctuation of exhaust air through the center hole 212*a*, b represents a curve illustrating pressure fluctuation of exhaust air through the side holes 212*c*, and c represents a curve illustrating pressure fluctuation of exhaust air through the exhaust hole 302.

FIG. 21 is a graph illustrating a pressure state of exhaust air under the condition that the chamber unit 200 is provided with only the center hole 212*a*.

In initial pressure fluctuation (curve a) through the center hole 212*a* of the chamber unit 200, a positive pressure and a negative pressure are alternately generated according to suction and exhaust of the pump unit.

That is, the pressure of the exhaust air is increased up to 1,000 mbar within an initial section through the center hole 212*a*, and is decreased up to −1,000 mbar by the rotation of the rotor 110*a*. Then, noise reduction is gradually achieved according to movement distances.

Finally, the exhaust air is exhausted to the outside of the vacuum pump through the exhaust hole 302 while having a positive pressure of 400 mbar and a negative pressure of −400 mbar, and noise reduction through the chamber unit 200 is achieved.

FIG. 22 is a graph illustrating a pressure state of exhaust air through the exhaust hole under the condition that the chamber unit 200 is provided with both the center hole 212*a* and the side holes 212*b*.

In initial pressure fluctuation through the center hole 212*a* of the chamber unit 200, a positive pressure and a negative pressure are alternately generated according to suction and exhaust of the pump unit.

That is, the pressure of the exhaust air is increased up to 1,000 mbar through the center hole 212*a*, and is decreased up to −1,000 mbar by the rotation of the rotor 110*a*.

In pressure fluctuation through the side holes 212*b*, a positive pressure and a negative pressure are alternately generated in the same manner as the pressure fluctuation through the center hole 212*a*, and noise is gradually reduced according to movement distances. Here, the exhaust air is exhausted to the outside of the vacuum pump 1 while reducing the pressure up to 200 mbar lower than the pressure of the exhaust air through the center hole 212*a*.

FIG. 23 is a graph comparing a pressure fluctuation state of exhaust air under the condition that the chamber unit is provided with both the center hole and the side holes and a pressure fluctuation state of exhaust air under the condition that the chamber unit is provided with only the center hole.

If the chamber unit 200 is provided with both the center hole 212*a* and the side holes 212*b*, the exhaust air is exhausted to the outside of the vacuum pump 1 while having a positive pressure of 210 mbar and a negative pressure of −200 mbar. Therefore, the chamber unit 200 provided with both the center hole 212*a* and the side holes 212*b* (curve a+b) has an improved noise reduction effect, compared with the chamber unit 200 provided with only the center hole 212*a* (curve a).

Accordingly, this proves that the vacuum pump in accordance with the present invention greatly reduces noise generated due to rotation of the rotor.

As is apparent from the above description, a vacuum pump for vehicles in accordance with the present invention minimizes noise generated during operation of the vacuum pump.

The vacuum pump for vehicles in accordance with the present invention rapidly radiates heat generated during operation of the vacuum pump using exhaust air, thereby preventing overheating of the vacuum pump.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum pump for vehicles comprising:

a motor housing provided with an air inlet through which air is sucked;

a pump unit disposed on the motor housing to generate a vacuum using the air sucked through the air inlet; and the pump unit comprising a rotor unit rotated by driving force generated from a motor; a cam ring into which the rotor unit is inserted; a base plate installed under the cam ring, and provided with a suction hole and a discharge hole; and an upper plate installed on the cam ring to cover the upper surface of the rotor unit, a chamber unit, the inside of which is divided, disposed on the pump unit, wherein the chamber unit includes:

an inner cap to cover the upper portion of the pump unit; and an outer cap to cover the upper portion of the inner cap, wherein the inner cap and the outer cap are communicated with each other, wherein the inner cap includes at least one opening to move exhaust air generated from the pump unit to the outer cap, wherein a volume of a space between the inner cap and the outer cap is larger than a volume of a passage of the at least one opening of the inner cap so that the exhausted air from the inner cap is diffused.

2. The vacuum pump for vehicles according to claim 1, wherein the inner cap and the outer cap are made of different materials.

3. The vacuum pump for vehicles according to claim 1, wherein the inner cap is made of aluminum, and the outer cap is made of any one of plastic and stainless steel.

4. The vacuum pump for vehicles according to claim 1, wherein the at least one opening includes a center hole formed at the center of the inner cap, and side holes separated from each other in the circumferential direction of the upper surface of the inner cap.

5. The vacuum pump for vehicles according to claim 1, wherein the outer cap includes support ribs disposed concentrically around the center of the inner surface of the outer cap.

6. The vacuum pump for vehicles according to claim 5, wherein the outer cap further includes connection members to connect the support ribs at a regular interval.

7. The vacuum pump for vehicles according to claim 1, wherein:

the inner cap is disposed to have one separation distance from the outer surface of the pump unit; and the outer cap is disposed to have another separation distance from the outer surface of the inner cap.

8. The vacuum pump for vehicles according to claim 1, further comprising a packing member between the pump unit and the motor housing to reduce vibration and to prevent air leakage.

9. The vacuum pump for vehicles according to claim 1, wherein the motor housing includes alignment members separated from each other at the same interval on the upper surface of the motor housing to achieve positional alignment of the pump unit.

10. The vacuum pump for vehicles according to claim 7, wherein each of the alignment members includes:

a first guide part rounded toward the center of the motor housing; and a second guide part bent to face the outside of the motor housing.

11. A vacuum pump for vehicles comprising:

a motor housing provided with an air inlet through which air is sucked;

a pump unit disposed on the motor housing to generate a vacuum using the air sucked through the air inlet; and the pump unit comprising a rotor unit rotated by driving force generated from a motor; a cam ring into which the rotor unit is inserted; a base plate installed under the cam ring, and provided with a suction hole and a discharge hole; and an upper plate installed on the cam ring to cover the upper surface of the rotor unit, a chamber unit disposed on the pump unit to reduce at least noise or heat generated during operation of the pump unit, wherein the chamber unit includes:

an inner cap to cover the upper portion of the pump unit; and an outer cap to cover the upper portion of the inner cap, wherein the inner cap and the outer cap are communicated with each other, wherein the inner cap includes at least one opening to move exhaust air generated from the pump unit to the outer cap; and wherein a volume of a passage between the inner cap and the outer cap is larger than a volume of a passage of the at least one opening of the inner cap so that the exhausted air from the inner cap is diffused.

12. The vacuum pump for vehicles according to claim 11, wherein the motor housing includes a cap, with which a controller to control the motor is integrated, mounted on the lower portion of the motor housing.

13. The vacuum pump for vehicles according to claim 12, wherein the cap includes:

an upper region, in which first electronic elements are disposed, provided in an upper area centering around the controller; and a lower region, in which second electronic elements operated at a higher-temperature state than the first electronic elements are disposed, provided in a lower area centering around the controller.

14. The vacuum pump for vehicles according to claim 12, wherein the cap includes an open hole provided with an opened lower surface.

15. The vacuum pump for vehicles according to claim 12, wherein the controller radiates heat generated during operation of the controller through the inside of the cap to exterior.

* * * * *